US007241139B2

(12) United States Patent
Zhu

(10) Patent No.: US 7,241,139 B2
(45) Date of Patent: Jul. 10, 2007

(54) CASTING SAND HEATING APPARATUS

(75) Inventor: Xudong Zhu, No. 188, Wangzhuang Road, New District, Wuxi, Jiangsu (CN) 214028

(73) Assignee: Xudong Zhu, Wuxi (CN)

( * ) Notice: Subject to any disclaimer, the term of this patent is extended or adjusted under 35 U.S.C. 154(b) by 0 days.

(21) Appl. No.: 10/517,091

(22) PCT Filed: Jan. 9, 2004

(86) PCT No.: PCT/CN2004/000029

§ 371 (c)(1),
(2), (4) Date: Dec. 6, 2004

(87) PCT Pub. No.: WO2005/070586

PCT Pub. Date: Aug. 4, 2005

(65) Prior Publication Data

US 2006/0099542 A1 May 11, 2006

(30) Foreign Application Priority Data

Jan. 7, 2004 (CN) ..... 2004 2 0024084

(51) Int. Cl.
*F27B 15/00* (2006.01)
*F27B 1/00* (2006.01)

(52) U.S. Cl. ..... 432/58; 432/95; 432/214

(58) Field of Classification Search ..... 432/58, 432/95, 96, 101, 102, 214, 215, 217, 218
See application file for complete search history.

(56) References Cited

U.S. PATENT DOCUMENTS 3,503,790 A * 3/1970 Gringras ..... 427/185
4,423,558 A * 1/1984 Meunier ..... 34/582
4,450,895 A * 5/1984 Meunier et al. ..... 165/104.18
4,978,076 A * 12/1990 Andrews et al. ..... 241/5
5,165,888 A * 11/1992 Rothschild et al. ..... 432/14
5,332,139 A * 7/1994 Heath et al. ..... 266/172

FOREIGN PATENT DOCUMENTS

| | | |
|---|---|---|
| CN | 2162314 Y | 4/1994 |
| JP | 55-73442 | 6/1980 |
| JP | 55-86645 | 6/1980 |
| JP | 7-328741 | 12/1995 |
| JP | 11-285779 | 10/1999 |
| JP | 2000-61578 | 2/2000 |

* cited by examiner

*Primary Examiner*—Gregory Wilson
(74) *Attorney, Agent, or Firm*—Hudak, Shunk & Farine Co. LPA

(57) ABSTRACT

This invention relates to a casting sand heating apparatus. The purpose of this invention is to provide a casting sand heating apparatus which can heat sand up to 300° C. or higher with high energy efficiency, lower capital investment and lower operating costs. This apparatus is comprised of a furnace body, sand inlet, smoke discharge and dust removing port, hearth and sand outlet. The sand inlet is arranged at the top of the furnace body, the combustion mouth is arranged in the lower part of the furnace body. Additionally, the heat exchange apparatus is arranged in the middle part of the furnace body. This invention can be used for the heating and baking of fresh and used casting sand.

10 Claims, 1 Drawing Sheet

CASTING SAND HEATING APPARATUS

BACKGROUND OF THE INVENTION

1. Technical Field

This invention herein relates to a casting sand heating apparatus used in the foundry industry.

2. Background

Nowadays, there are two types of apparatus for heating sand. The first is a fluidized bed heating furnace, wherein the sand passing through the horizontal bed is fully covered by horizontal burning nozzles. In the furnace heat exchange is carried out between the sand and the flame at a high temperature so that the sand is heated. The efficiency of this heating device is low, it is less productive (3 metric tons per hour) and expensive. The total cost of this device is about $325,000, in China, and it is not acceptable for common manufactures. This type of heating apparatus has low efficiency, small capacity and high operating costs.

The second sand heating method is used by several Chinese manufactures. It burns gas, oil, or other energy source in a separate combustion chamber outside the furnace to generate high temperature air. The high temperature air is mixed with a certain amount of ambient air or recycled warm air to heat the sand in the heating apparatus. The temperature of the air produced from the above mentioned steps is lower than the temperature (500° C.) under which the furnace can withstand. In the furnace, two spiral lamina muddlers are arranged to mix the sand by revolving oppositely to carry out the heat exchange between the sand and the heated air. The whole apparatus is horizontal with one end for sand and heated air intake, and the other is for sand and surplus gas discharge. This type of apparatus can not meet the technical requirements of heating the sand up to 300° C.

DETAILED DESCRIPTION

The purpose of this invention is to overcome the deficiencies of the current technology by providing a high capacity sand heating apparatus which can be used to heat the sand to 300° C. or higher with high energy efficiency, lower capital investment and lower operating costs.

This invention is a novel casting sand heating apparatus. This apparatus is comprised of a furnace body, sand inlet, smoke discharge and dust removing port, hearth and sand outlet. The sand inlet is arranged at the top of the furnace body, the combustion nozzles are arranged at the bottom of the furnace body and a heating device is arranged in the hearth which is in the middle part of the furnace body.

The above mentioned heat exchange apparatus comprises: crossing net frames made of multi-layer refractory material; partitions with sieve holes; multi-layer crisscrossly arranged tilted stripes and any other configuration which can disperse the sand and slow its falling speed.

The above mentioned furnace body can be of numerous kinds of shapes. The vertical type wherein its height is greater than its width has the optimal heating effect.

The objectives of this invention are carried out by its high efficiency, countercurrent heat exchange; increased heat exchange area, while meeting the productivity requirements. The furnace body's height is greater than its width. The flame generated by the combustion at the bottom of the furnace body is the heat source. The heat source can be at the bottom or lower part of the furnace body, or separated from the furnace body. The heated air flow is forced into the furnace heat exchange media. The heated air flow goes up the whole hearth. The cold sand enters the furnace from the top of the furnace body, falling through the hearth with a kind of grid-type heat exchange device, so the sand within the hearth encounters the rising heated airflow and countercurrent heat exchange is carried out. This novel grid-type hearth increases the path and residence time for heating the sand, thus achieving a higher sand temperature. After the heat exchange, the sand keeps on falling, going through the combustion chamber, contacting the high temperature flame for a short period of time and then goes to the sand outlet by meeting the temperature requirements at this point.

The current technology of the heat exchange device disperses the sand from the sand inlet to the entire cross section of the hearth. The improvement of this invention includes a sand inlet guidance apparatus installed at the sand inlet. The said guidance apparatus is made of refractory material, and contains a certain number of sand dispersing tubes or grooves distributed inside the furnace, or a multi-layer crisscrossly arranged with circular cone sand dispersing units with its quantities increased in the downward direction.

This invention also includes, a dust removing duct connected to the smoke discharge and dust removing port. The cold air duct is attached to the dust removing duct.

For the purpose of discharging the dust and smoke, the dust and smoke removing duct is induced from the top of the smoke discharge tube into the dust collector. The said tube has sufficient length for cool air inlets and mixing and cooling the air enough so that the bags in the dust collector can withstand the temperature.

The energy needed for heating large quantities of sand, can not be satisfied by only using a flame. Heat transfer media is also needed. A smoke return tube is installed at the outside wall of the furnace body, with one end connected to the dust removing tube and the other end is connected to the upper side of the combustion mouth on the wall of the furnace. A smoke circulating apparatus such as, a boiler intake fan is installed in the smoke return tube. The circulating apparatus recycle part of the smoke from the smoke discharge and dust removing port at the top of the furnace.

The smoke returns to the combustion chamber and a sufficient quantity of smoke, the heat-exchange media, to heat the sand. At the same time, the residual heat is utilized to improve the heating efficiency. Additionally, the heat exchange device is protected from overheating, thus prolonging its operative life.

Thermocouples are installed on each part of the furnace body as well as the sand outlet, smoke discharge and dust removing tube. By inputting the signal at each measuring point into the computer system for the production control and after such data is processed, the heating temperature control can be achieved. A computer control system work station is located near the furnace body to carry out automation control and simulating screen display of the operations of the heating furnace, combustion system and dust removing system by collecting flow rate signals from the burner and pressure signals from the dust removing ducts.

For the ease of maintenance, a check door is arranged at the lower part of the furnace body.

This invention has significant advantages over the current technology as illustrated below:

High efficiency countercurrent heat exchange is achieved by the cold sand falling and hot air rising in the hearth at the same time.

The sand falls through a special grid type furnace hearth, that disperses the sand and extends the falling path and residence time.

Heat exchange is much more efficient, the second time air supplement supplies enough smoke needed to heat a large quantity of sand, thus saving fuel and improving the heating efficiency.

The sand can contact the high temperature flame directly for a short period of time while falling through the combustion chamber, thus providing further heating. By installing a controllable burner, the sand can be heated to a high temperature (more than 700° C.) with automatic control.

The inner structure of the heating apparatus uses refractory material. This allows for a much larger heating apparatus to be constructed with significantly lower cost.

With process control, through a computer system, the heating apparatus can be fully automated. The operation is stable and with high efficiency, the apparatus' vertical configuration allows for efficient use of space. An explosion-proof apparatus is installed to ensure its safety and reliability.

Figure 1:
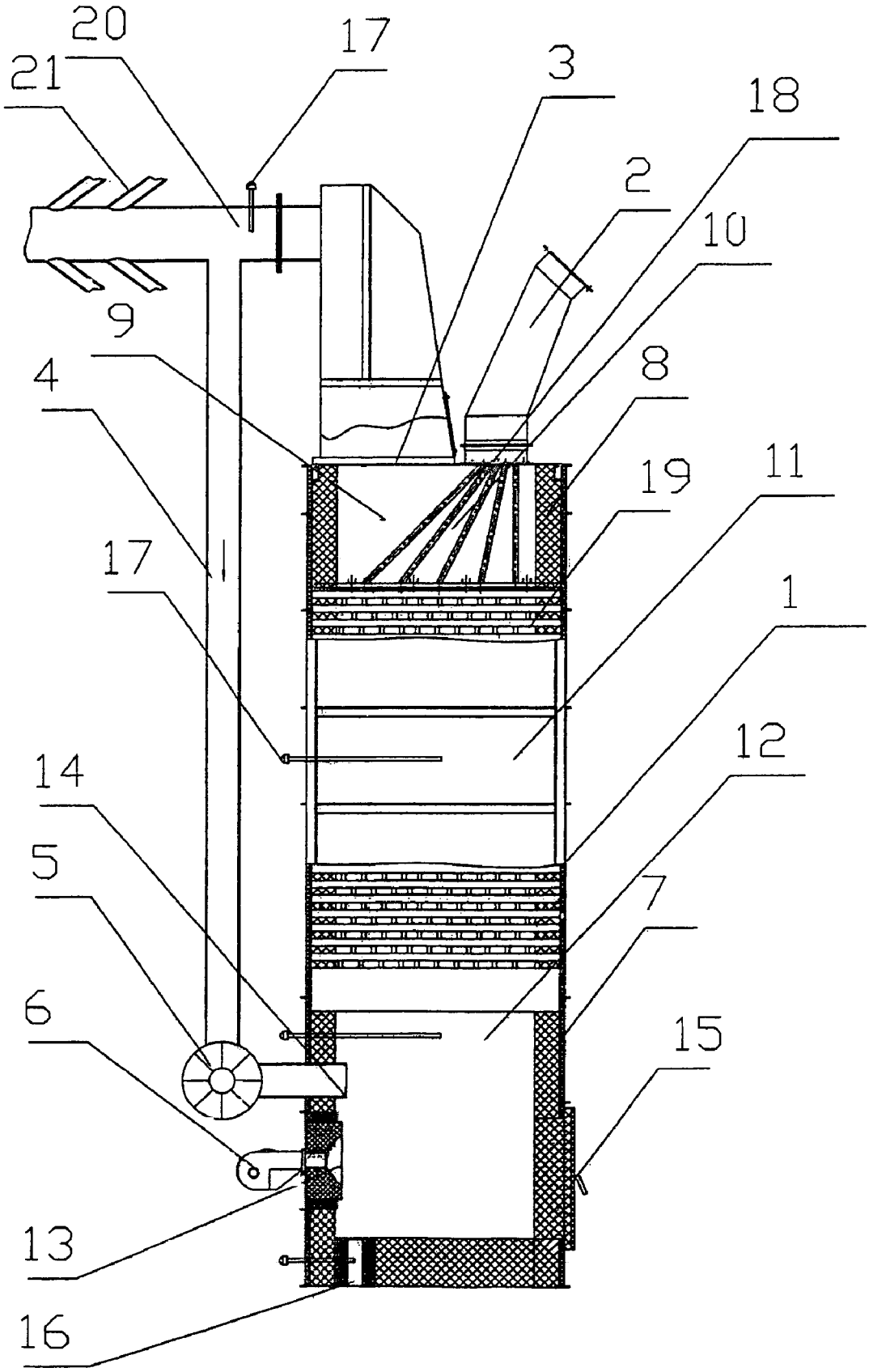
FIG. 1 is a side view of the Casting Sand Apparatus.

1—furnace body
2—sand in groove
3—smoke discharge and dust removing port
4—smoke return duct
5—boiler air intake fan
6—burner
7—insulation
8—firebrick
9—sand dispersing chamber
10—sand dispersing tube
11—hearth
12—combustion chamber
13—combustion mouth
14—smoke return duct
15—check door
16—sand outlet
17—thermocouple
18—sand inlet
19—heat exchanger
20—dust removing duct
21—cold air duct

EXAMPLE

FIG. 1 illustrates a heating apparatus for casting sand, it includes a vertical furnace body 1, its height is greater than its width; a sand inlet 18 which is located at the top, a smoke discharge and dust removing port 3 and dust removing duct 20, which are connected thereto; sand in groove 2 on sand inlet 18; cold air duct 21 on dust removing duct 20. One end of smoke return duct 4 on the outside wall of the furnace body 1 is connected to dust removing duct 20, another end connected to smoke return inlet 14. Boiler air intake fan 5 is connected to the smoke return duct 4. Combustion mouth 13 is installed near the outside wall of the lower part of the furnace body 1, with burner 6 connected thereto. The wall of the furnace body 1 is comprised of a steel plate, insulation 7 and firebricks 8 which is the inner side thereof. From the top to the bottom, the inner structure includes: sand dispersing chamber 9 and sand dispersing tubes 10 therein and hearth 11 thereunder, heat exchanger 19 is installed in hearth 11 and it is built up by a certain number of casting refractory bars and the bars are crisscrossly arranged as a multi-layer grid structure. Combustion chamber 12 is at the lower part of the hearth 11, smoke return duct 14, combustion mouth 13 and check door 15 are on its side wall.

Thermocouples 17 are arranged at the upper part, middle, and lower part of the furnace body 1, smoke discharge duct 20 and sand outlet 16, the signal of the thermocouples is transmitted into the computer control system to carry out the temperature control. Pressure sensors are arranged in the dust removing duct 20, the signals of the pressure sensors are transmitted into the computer control system to carry out the automatic control of the dust removing system.

Fuel sprays out from the burner 6 and is ignited to generate a high temperature flame at the combustion mouth 13, the flame heats the large quantity of air induced from the smoke discharge and dust removing port 3 and generates high temperature air flow that rises up; cold sand enters into the sand dispersing tubes 10 from sand inlet 18, then falls through the heat exchanger 19 in hearth 11. High heat exchange efficiency is obtained in this way. Grid type hearth 11 can disperse the sand while it is falling and allows the falling sand to have enough heat exchange area, path and residence time in contact with the rising high temperature air flow so sufficient heat exchange is obtained.

The heated sand continues to fall and goes through the combustion chamber 12 and contacts the high temperature flame directly so the sand is further heated and its temperature is high enough to meet the technical requirements, then it is uploaded through the sand outlet 16 at the bottom of the furnace body 1.

All the temperatures at the measuring points are measured by thermocouple 17. The heating temperature can be controlled by adjusting the fuel flow rate of burner 6. At the top of the furnace body, a smoke discharge and dust removing port 3 are arranged and on the lower part of the furnace body 1, there exists a check door 15. Part of the smoke discharged from the furnace is recycled back to the combustion chamber 12 by a boiler air intake fan 5 through smoke return duct 4 to supply the smoke needed to heat large quantities of sand at high efficiency.

This inventor can be used for heating or baking of fresh and used casting sand.

What is claimed is:

1. A casting sand heating apparatus, comprising a furnace body, sand inlet, smoke discharge and dust removing port, hearth, combustion mouth and sand outlet, wherein the sand inlet is arranged at the top of the furnace body, the combustion mouth is arranged in the lower part of the furnace body, the sand outlet is arranged at the bottom of the furnace body and near the side of the combustion mouth, a multi-layer heat exchange apparatus is arranged crisscrossly in the middle part of the furnace body, and wherein a dust removing duct is connected to the smoke discharge and the dust removing port, and a cold air duct is connected to the dust removing duct.

2. The casting sand heating apparatus of claim 1, wherein the multi-layer heat exchange apparatus is comprised of multi-layer crisscrossly arranged laths.

3. The casting sand heating apparatus of claim 2, wherein a sand inlet guidance apparatus is installed on the sand inlet.

4. The casting sand heating apparatus of claim 1, wherein the multi-layer heat exchange apparatus is comprised of multi-layer partitions with sieve holes.

5. The casting sand heating apparatus of claim 4, wherein a sand inlet guidance apparatus is installed on the sand inlet.

6. The casting sand heating apparatus of claim 1, wherein the multi-layer heat exchange apparatus is comprised of multi-layer crisscrossly arranged laths of casting refractory material.

7. The casting sand heating apparatus of claim 6, wherein a sand inlet guidance apparatus is installed on the sand inlet.

8. The casting sand heating apparatus of claim 1, wherein a sand inlet guidance apparatus is installed on the sand inlet.

9. The casting sand heating apparatus of claim 1, wherein a smoke return duct is installed at the outside wall of the furnace body, one end of the duct is connected to the dust removing duct, the other end is connected to the upper side of the combustion mouth on the wall of the furnace, and a smoke circulating power apparatus is installed in the smoke return duct.

10. The casting sand heating apparatus of claim 9, wherein a check door is arranged on the lower part or at the bottom of the furnace body.

* * * * *